US010145564B2

(12) United States Patent
Jang

(10) Patent No.: US 10,145,564 B2
(45) Date of Patent: Dec. 4, 2018

(54) COOKING APPLIANCE

(71) Applicant: LG ELECTRONICS INC., Seoul (KR)

(72) Inventor: Jaebong Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 450 days.

(21) Appl. No.: 14/939,056

(22) Filed: Nov. 12, 2015

(65) Prior Publication Data

US 2016/0187000 A1 Jun. 30, 2016

(30) Foreign Application Priority Data

Dec. 24, 2014 (KR) ..... 10-2014-0188073

(51) Int. Cl.

| | |
|---|---|
| ***F24C 3/08*** | (2006.01) |
| ***F24C 15/10*** | (2006.01) |
| ***F24C 3/12*** | (2006.01) |
| ***F24C 7/08*** | (2006.01) |
| ***F24C 15/08*** | (2006.01) |

(52) U.S. Cl.

CPC ..... *F24C 3/126* (2013.01); *F24C 7/083* (2013.01); *F24C 15/08* (2013.01)

(58) Field of Classification Search

CPC .. F24C 3/12; F24C 3/122; F24C 3/124; F24C 3/126; F24C 5/16; F24C 7/08; F24C 7/081; F24C 7/082; F24C 7/083

See application file for complete search history.

(56) References Cited

U.S. PATENT DOCUMENTS

| | | | | |
|---|---|---|---|---|
| 3,509,605 A | | 5/1970 | More | |
| 3,877,457 A | * | 4/1975 | Doner | F24C 3/124 126/39 R |
| 5,375,921 A | * | 12/1994 | Tupa | A47L 15/42 312/257.1 |
| 8,910,622 B2 | * | 12/2014 | Mishra | F24C 15/107 126/212 |

(Continued)

FOREIGN PATENT DOCUMENTS

| | | |
|---|---|---|
| JP | 2012-093019 | 5/2012 |
| KR | 20-1995-0006094 | 7/1995 |

(Continued)

OTHER PUBLICATIONS

Extended European Search Report issued in European Application No. 15188548.0 dated Apr. 15, 2016, 7 pages.

(Continued)

*Primary Examiner* — David J Laux
(74) *Attorney, Agent, or Firm* — Fish & Richardson P.C.

(57) ABSTRACT

A cooking appliance includes a cabinet defining an exterior appearance of the cooking appliance and a top plate disposed on the cabinet. The top plate includes a first cooking unit configured to perform cooking using a heat source. The cooking appliance also may include a second cooking unit provided in the cabinet, the second cooking unit being configured to perform cooking using a heat source. The cooking appliance further includes a control panel with one or more manipulation units coupled to a front portion of the top plate and a bracket coupled to the top plate and configured to detachably couple the control panel to the front portion of the top plate.

19 Claims, 9 Drawing Sheets

(56) References Cited

U.S. PATENT DOCUMENTS

| | | | | |
|---|---|---|---|---|
| 2009/0153004 | A1 | 6/2009 | Han et al. | |
| 2009/0296371 | A1 | 12/2009 | Desmet et al. | |
| 2014/0319122 | A1* | 10/2014 | Ruperee ..... | F24C 15/108<br>219/453.11 |

FOREIGN PATENT DOCUMENTS

| | | |
|---|---|---|
| KR | 20-0349531 | 4/2004 |
| KR | 200366745 | 11/2004 |
| KR | 10-2006-0033930 | 4/2006 |
| KR | 10-2014-0018565 | 2/2014 |
| WO | 2014118304 | 8/2014 |

OTHER PUBLICATIONS

European Search Report in European Application No. 10-2015-0065722, dated Mar. 9, 2017, 6 pages (with English translation).

* cited by examiner

Fig. 1 (a)
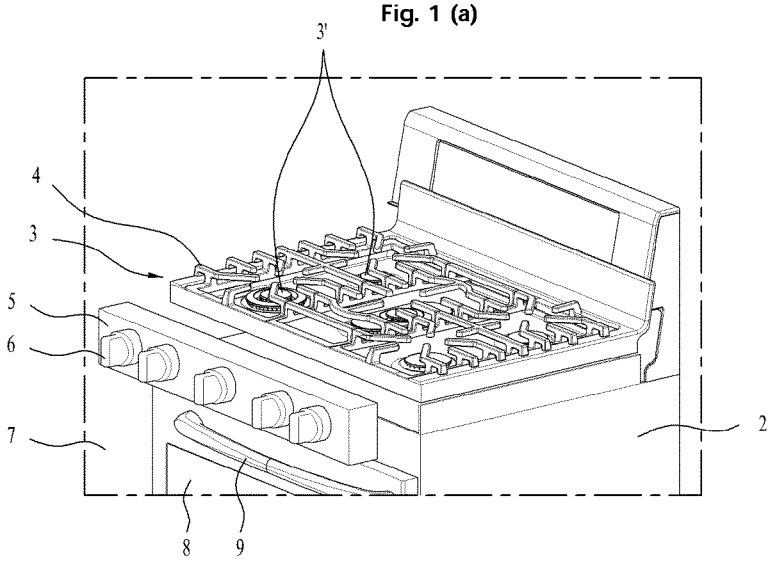
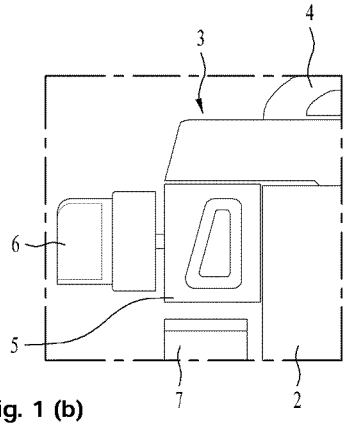
Fig. 1 (b)
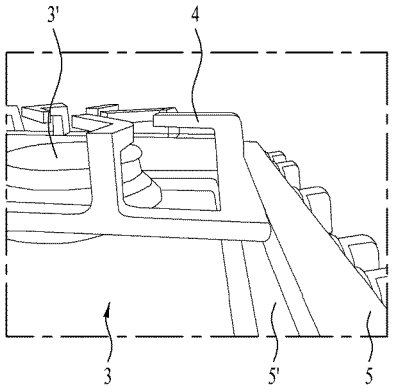
Fig. 1 (c)

COOKING APPLIANCE

CROSS-REFERENCE TO RELATED APPLICATIONS

This application claims priority to Korean Patent Application No. 10-2014-0188073 filed on Dec. 24, 2014 in Korea, the entire contents of which is hereby incorporated by reference in its entirety.

FIELD

The present disclosure relates to a cooking appliance including, for example, a cooking appliance in which a control panel having a manipulation unit is coupled to a top plate in a manner that reduces heat conduction to the control panel from a cooker stand placed on the top plate and/or reduces an error of a manipulation unit caused by a liquid flowing along a gas line or a gas valve between the control panel and the top plate.

BACKGROUND

Generally, cooking appliances may include electric appliances for cooking in a house or a building, using electricity or other energies (e.g., gas). Examples of such cooking appliances using gas as a heat source include gas stoves, gas ovens and gas oven ranges. Examples of the cooking appliances using electricity as the heat source include induction ranges and microwave ovens. Combined types of cooking appliances include induction ranges using electricity and gas ovens using gas.

FIGS. 1A-1C illustrate an example cooking appliance. Referring to FIGS. 1A and 1B, the example cooking appliance 1 includes a cabinet 2, a top plate 3 disposed on the cabinet 2 and having one or more ignition units 3', a cooker stand 4 arranged on the top plate 3, a door 7 coupled to a front of the cabinet 2 and having a handle 9 for opening and closing a cooking chamber and a transparent member 8 (e.g., glass) provided in a center thereof, and a control panel 5 provided at a front portion of the cabinet 2 and having one or more manipulation units 6 arranged above the door 7.

As shown in FIGS. 1A and 1B, the control panel 5 has been coupled to the top plate 3 by a plurality of bolts and the top plate 3 has to be coupled to an upper portion of the cabinet 2 by a plurality of bolts to fixedly secure the control panel 5 thereto. Accordingly, the coupling process of the control panel 5 may be difficult. The plurality of the bolts used for the top plate 3 and the control panel 5 have to be unfastened for maintenance of the control panel 5 and/or the manipulation units 6, which may be disadvantageous.

Moreover, a front portion of the top plate 3 is disposed over the control panel 5. Specifically, the top plate 3 is disposed on the cabinet 2 with a lower surface of the front portion in contact with a top surface of the control panel 5.

Because the top plate 3 is typically formed of a metallic material, heat may be conducted to an entire area of the top plate 3 from the one or more ignition units 3'. Accordingly, when a user cooks, using the one or more ignition units 3', the temperature of the top plate 3 may rise. As a consequence, the heat might be conducted from the high-temperature top plate 3 to the control panel 5 in contact with the lower surface of the front portion of the top plate 3. When heat transfers from the top plate 3 to the control panel 5 and the user tries to manipulate the manipulation unit 6 of the control panel 5, the user's hand may touch the control panel 5 and get burned. In addition, the control panel 5 is disposed under the front portion of the top plate 3 and the user's hand might touch the top plate 3 and burned when the user tries to manipulate the manipulation unit 6.

FIG. 1C partially illustrates another example cooking appliance. Referring to FIG. 1V, the control panel 5 includes a stepped portion 5' projected toward the top plate 3.

At this time, the cooker stand 4 has at least predetermined portion disposed on the stepped portion 5'. With this structure, heat may be conducted to the control panel 5 from the one or more ignition units 3' through the cooker stand 4 and the temperature of the control panel 5 may rise. Accordingly, when a user tries to manipulate the manipulation unit 6 of the control panel 5, the user's hand may touch the control panel 5 and get burned.

Also, a fluid material such as a liquid flowing over the cooker may permeate between the control panel 5 and the top plate 3. The liquid permeated between the control panel 5 and the top plate 3 might flow along a gas line or a gas valve connected between the manipulation unit 6 of the control panel 5 and the one or more ignition units 3' of the top plate 3, which may cause an error of the manipulation unit 6.

SUMMARY

In one aspect, a cooking appliance includes a cabinet defining an exterior appearance of the cooking appliance and a top plate disposed on the cabinet. The top plate includes a first cooking unit configured to perform cooking using a heat source. The cooking appliance further includes a control panel coupled to a front portion of the top plate. The control panel includes one or more manipulation units. In addition, the cooking appliance includes a bracket coupled to the top plate and configured to detachably couple the control panel to the front portion of the top plate.

Implementations may include one or more of the following features. For example, a gap may exist between a front surface of the top plate and the bracket and a predetermined area of the control panel may be inserted into the gap such that a rear surface of the control panel contacts the front surface of the top plate. Also, the cooking appliance may include a second cooking unit provided in the cabinet, the second cooking unit being configured to perform cooking using a heat source.

In some implementations, the bracket includes a vertical portion that vertically extends throughout an overall length of the bracket and one or more projections that are projected from the vertical portion toward the top plate. In these implementations, an upper end of the vertical portion and the top plate are spaced apart a predetermined distance from each other with respect to the one or more projections.

The one or more projections may include a plurality of projections that are provided in the vertical portion and the plurality of the projections may be spaced apart a predetermined distance from each other along a longitudinal direction of the bracket. The control panel may include a rear wall that extends downward at a rear portion of the control panel and the rear wall may be fitted between the vertical portion of the bracket and a front surface of the top plate to fixedly couple the control panel between the vertical portion of the bracket and the top plate. A thickness of the rear wall may be equal to or larger than a gap between an upper end of the vertical portion and the top plate.

In some examples, the bracket includes a horizontal portion that horizontally extends from a lower end of the vertical portion to define a passage configured to accommodate or guide a liquid permeated between the rear wall of the control panel and the front surface of the top plate. In these examples, a first width-direction end of the horizontal portion may be connected to a lower end of the vertical portion and the bracket may include a guide rib that extends upward at a second width-direction end of the horizontal portion. Also, in these examples, the horizontal portion may be inclined toward longitudinal ends of the horizontal portion from a longitudinal center of the horizontal portion.

An upper end of the vertical portion may be bent at a predetermined angle toward a front portion of the cooking appliance. Both longitudinal ends of the bracket may be open. Also, the cooking appliance may include side brackets that are provided at width-direction surfaces of the cabinet and longitudinal surfaces of the control panel and the side brackets may be fastened to each other by one or more fastening members.

Further, the control panel may include an inclined surface that is inclined downward a predetermined angle toward a front portion of the cooking appliance, and the one or more manipulation units may be provided at the inclined surface. The cooking appliance may include a cooker stand disposed on the top plate. The top plate may include a projection that is projected upward at a front portion of the top plate and a rear surface of the control panel may contact a front surface of the projection and a predetermined area of the cooker stand may contact a rear surface of the projection. Also, the cooker stand and the control panel may be spaced apart a predetermined distance from each other.

In another aspect, a cooking appliance includes a cabinet defining an exterior appearance of the cooking appliance and a top plate disposed on the cabinet. The top plate includes a first cooking unit configured to perform cooking using a heat source. The cooking appliance also includes a second cooking unit provided in the cabinet, the second cooking unit being configured to perform cooking using a heat source. The cooking appliance also includes a control panel coupled to a front portion of the top plate. The control panel includes one or more manipulation units. In addition, the cooking appliance includes a bracket coupled to the top plate and configured to detachably couple the control panel to the top plate with a gap defined between an upper end of the bracket and an upper end of the top plate. A part of the control panel is configured to insert into the gap defined between the bracket and the top plate to couple the control panel to the top plate.

Implementations may include one or more of the following features. For example, the bracket may include a vertical portion that vertically extends throughout an overall length of the bracket and a horizontal portion that horizontally extends from a lower end of the vertical portion. In this example, the horizontal portion may define a passage configured to accommodate and guide a liquid permeated between a rear wall of the control panel and a front surface of the top plate.

In addition, a first width-direction end of the horizontal portion may be connected to a lower end of the vertical portion and the bracket may include a guide rib that extends upward at a second width-direction end of the horizontal portion. Also, the horizontal portion may be inclined toward both longitudinal ends of the horizontal portion from a longitudinal center of the bracket.

Further scope of applicability of the present disclosure will become apparent from the detailed description given below. The detailed description and specific examples, while indicating implementations, are given by illustration only, since various changes and modifications within the spirit and scope of the disclosure will be apparent to those skilled in the art from this detailed description.

BRIEF DESCRIPTION OF THE DRAWINGS

FIGS. 1A-C are diagrams illustrating examples of conventional cooking appliances;

DETAILED DESCRIPTION

A cooking appliance in accordance with exemplary implementations of the present disclosure will be described in detail, referring to the accompanying drawings. The accompanying drawings are used to illustrate various technical features and the implementations described herein are not limited by the accompanying drawings. As such, the present disclosure extends to alterations, equivalents, and substitutes in addition to those which are particularly set out in the accompanying drawings. For the sake of brevity with reference to the drawings, the same or equivalent components may be provided with the same reference numbers, and description thereof will be reference, rather than repeated.

Figure 2:
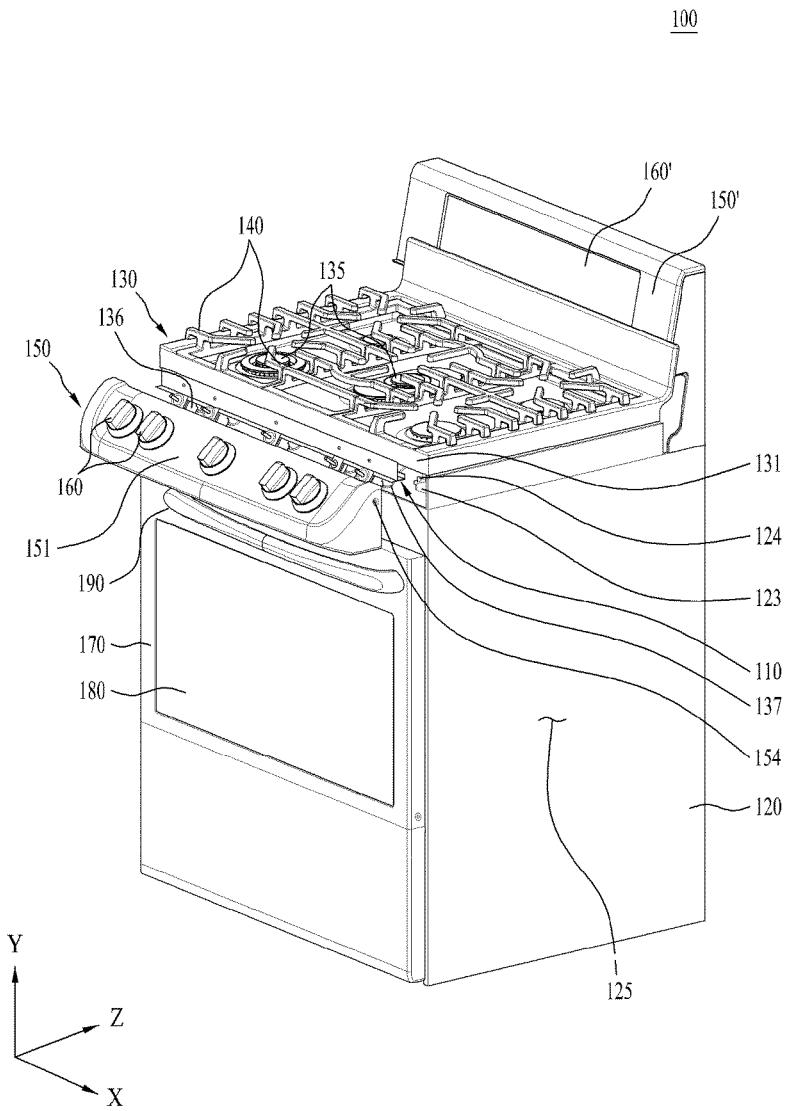
FIG. 2 is a perspective diagram illustrating an example cooking appliance.
Figure 3:
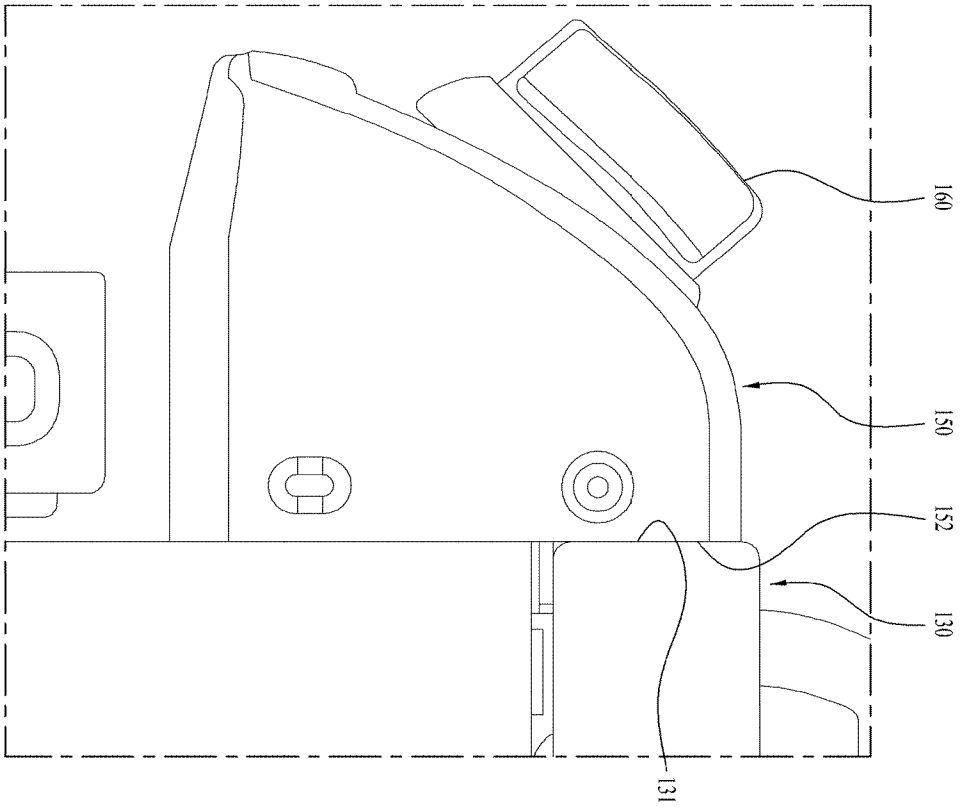
FIG. 3 is a perspective diagram illustrating an example arrangement relation between a control panel and a top plate provided in the cooking appliance shown in FIG. 2.

FIG. 2 illustrates an example cooking appliance. FIG. 3 illustrates an example arrangement relation between a control panel and a top plate provided in the cooking appliance shown in FIG. 2. For convenience and ease of explanation, features of the present disclosure are described with respect to a cooking appliance using gas as a heat source. The features also may be applied to a cooking appliance using electricity (or other heat sources) as the heat source.

X-axial direction is defined as a width direction of the cooking appliance or a width direction of a cabinet. Y-axial direction is defined as a height direction of the cooking appliance or a height direction of the cabinet. Z-axial direction is defined as a back-and-forth depth direction of the cooking appliance or a back-and-forth depth direction of the cabinet.

Referring to FIGS. 2 and 3, the cooking appliance 100 may include a cabinet 120 which defines an exterior appearance of the cooking appliance and a top plate 130 disposed on the cabinet 120 having a first cooking unit 135. The cooking appliance 100 also may include a second cooking unit 125 provided in the cabinet 120, a control panel 150 coupled to a front portion of the top plate 130, and a bracket 110 (or a first bracket) provided between the top plate 130 and the control panel 150 to couple the control panel 150 to the top plate 130.

The top plate 130 may be arranged on the cabinet 120. The top plate 130 may include one or more first cooking units 135 where cooking is performed using a heat source, and a cooker stand 140 provided on the one or more first cooking units 135. The heat source may be gas or electricity. In the present disclosure, gas is used as the heat source as an example.

The first cooking unit 135 may be referred to as an ignition unit. For instance, gas may be supplied toward the first cooking unit 135 from a gas supply source and the first cooking unit 135 may ignite the supplied gas to generate a fire for cooking.

The second cooking unit 125 may include a gas oven. The gas oven may operate in a manner the same or similar to conventional gas ovens. Accordingly, a method for operating a second cooking unit 125 (or a cooking method using such the second cooking unit 125) would be understood by a person of ordinary skill in the art.

The control panel 150 may be coupled to the top plate 130. Specifically, the control panel 150 may be coupled to the top plate 130, above the door 170 provided in a front surface of the cabinet 120 to open and close the second cooking unit 125. As shown in FIG. 2, the door 170 may be provided in the front of the cabinet 120 to open and close the second cooking unit 125. The door 170 may include a transparent portion 180 that enables visibility into an inside of the second cooking unit 125 and a handle 190 to open and close the door 170.

One or more manipulation units 160 may be provided in the control panel 150. Specifically, one or more manipulation units 160 may be rotary knobs. The user may rotate the manipulation units 160 to ignite the gas supplied to the first cooking unit 135 or control a level of the fire generated in the first cooking unit 135.

In addition, an inclined surface 151 may be formed in the control panel 150 and the inclined surface 151 may be inclined a predetermined angle downward to a front of the cooking appliance 100. In this instance, the manipulation unit 160 may be provided in the inclined surface.

The inclined surface 151 may be formed to make a lower portion more projected toward the front of the cooking appliance 100 than an upper portion of the control panel 150. For example, the inclined surface 151 may be inclined 30 to 60 degrees with respect to the ground where the cooking appliance 100 is installed. As the manipulation unit 160 is arranged in the inclined surface 151, user accessibility to the manipulation unit 160 may be enhanced.

The cooking appliance 100 further may include a rear panel 150' provided in a rear upper portion of the cabinet 120. The rear panel 150 may be arranged in an upper portion of the cabinet 120 and may be projected upward.

A chamber-type control command input unit 160' may be provided in the rear panel 150' to control the second cooking unit 125. The control command input unit 160' may be provided in a front surface of the rear panel 150' as a touch panel type.

The user can select and touch the control command input unit 160' to input a course, a time, and the like, which are displayed on the control command input unit 160'. Cooking environments inside the second cooking unit 125 including the amount of the gas supplied to the second cooking unit 125, the temperature inside the second cooking unit 125, and the cooking time in the second cooking unit 125 may be controlled.

In addition, a gas control valve 136 and a gas line 137 may be arranged between the manipulation unit 160 of the control panel 150 and the first cooking unit 13. The number of the manipulation units 160 may be equal to the number of the first cooking units 135. The number of the gas control valves 136 and gas lines 137 may be equal to the number of the manipulation units 160.

The manipulation units 160 may be provided in a front portion of the control panel 150 and the gas control valves 136 may be connected with the manipulation units 160 at a rear portion of the control panel 150. The gas lines 137 may connect the gas control valves 136 and the first cooking unit 135 with each other. For instance, the gas control valves 136 and the gas lines 137 may be arranged under a top surface of the control panel and under a top surface of the top plate 130. In this regard, gas supplied to a gas control valve 136 by a gas supply source may be supplied to the first cooking unit 136 by the manipulation (rotation) of the manipulation unit 160 via the gas line 137.

The bracket 110 may be coupled to the top plate 130, with a predetermined gap formed with a front surface 131 of the top plate 130. In this example, a predetermined area or more of the control panel is inserted in (or fitted to) the gap formed between the bracket 110 and the front surface 131 of the top plate 130 to couple the control panel 150 to the top plate and the bracket 110.

Referring to FIG. 3, the predetermined area or more of the control panel 150 may be inserted in the gap to make a rear surface 152 of the control panel 150 in surface-contact with the front surface 131 of the top plate 130.

Accordingly, the control panel 150 may be arranged in a manner in which the rear surface 152 of the control panel 150 contacts the front surface 131 of the top plate 130. In this regard, the rear surface 152 of the control panel 150 may be arranged to face the front surface 131 of the top plate 130.

Referring again to FIG. 2, a side bracket 123 (or a second bracket) may be provided at each of the width-direction surfaces of the cabinet 120. The side bracket 123 and each of longitudinal direction surfaces of the control panel 150 may be fastened to each other by a fastening member.

Specifically, a fastening hole 124 may be formed in the side bracket 123 and a fastening hole 157 corresponding to the fastening hole 124 may be formed in each of the longitudinal direction surfaces of the control panel 150. Fastening members (e.g., a bolt) penetrate the fastening holes 124 formed in the side brackets 123 and the fastening holes 157 formed in the longitudinal-direction surfaces of the control panel 150, respectively, so that both longitudinal-direction surfaces of the control panel 150 may be fixed to the side bracket 123. In this regard, the control panel 150 may be fixed to the side bracket 123, with the longitudinal-direction surfaces surrounding the side bracket 123.

Accordingly, the coupling process between the top plate 130 and the control panel 150 may be facilitated and the decoupling process for maintenance of the control panel 150 or the manipulation units 160 also may be facilitated.

The coupling process of the bracket 110 will be described below, referring to other drawings. The control panel 150 may be spaced apart a predetermined distance from the cooker stand 140 to reduce (e.g., prevent) heat conduction to the control panel 150 from the cooker stand 140 provided on the top plate 130, which will be described in more detail referring to FIGS. 4 and 5.

Figure 4:
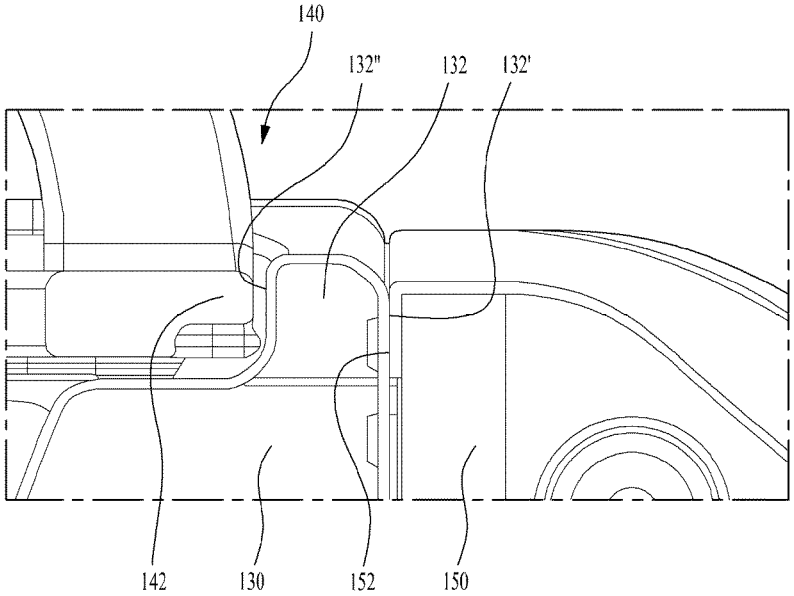
FIG. 4 is a sectional diagram illustrating an example arrangement relation among the control panel, the top plate, and a cooker stand provided in the cooking appliance shown in FIG. 2.
Figure 5:
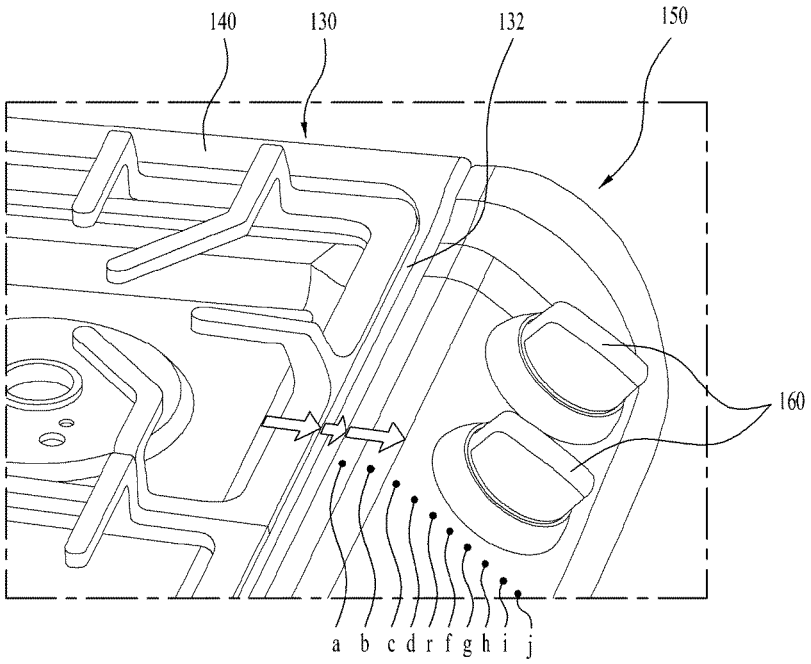
FIG. 5 is a perspective diagram illustrating an example arrangement relation and an example heat transfer relation between the control panel and the cooker stand provided in the cooking appliance shown in FIG. 2.

FIG. 4 illustrates an example arrangement relation among the control panel 150, the top plate 130, and a cooker stand 140 provided in the cooking appliance shown in FIG. 2 and FIG. 5 illustrates an example arrangement relation and an example heat transfer relation between the control panel 150 and the cooker stand 140 provided in the cooking appliance shown in FIG. 2.

Referring to FIGS. 4 and 5, the cooker stand 140 may directly contact with the fire generated in the first cooking unit 135 and the temperature of the cooker stand 140 may significantly raise by the ignition of the first cooking unit 135.

When the cooker stand 140 is arranged to directly contact the control panel 150, heat conduction to the control panel 150 from the cooker stand 140 may occur to raise the temperature of the control panel 150. Because the manipulation units 160 are provided in the control panel 150, a rising temperature of the control panel 150 may result in a concern that a user trying to manipulate the manipulation unit 160 could get burned. To reduce (e.g., prevent) the rise of the temperature of the control panel 150, the cooker stand 140 disposed on the top plate 130 may be spaced apart a predetermined distance from the control panel 150. Specifically, a projection 132 projected upward may be formed in a front portion of the top plate 130.

A rear surface 152 of the control panel 150 contacts with a front surface 132' of the projection 132 and at least predetermined area of the cooker stand 140 may contact with a rear surface 132" of the projection 132. A position of the front surface 132' of the projection 132 may be equal to the position of the front surface 131 of the top plate mentioned above. For example, a rear surface 152 of the control panel 150 toward the top plate 130 from the control panel 150 may contact with the front surface 132' of the projection 132.

The front surface 132' of the projection 132 may be a surface extended upward from the front surface 131 of the top plate 130 mentioned above. The front portion 142 of the cooker stand 140 arranged toward the control panel 150 from the cooker stand 140 may contact with the rear surface 132" of the projection 132.

When the heat of the fire generated in the first cooking unit 135 is transferred to the cooker stand 140, the heat may be transferred to the control panel 150 through the projection 132 of the top plate 130 which contacts with the cooker stand 140. The projection 132 of the top plate 130 arranged between the cooker stand 140 and the control panel 150 primarily blocks the heat transferred from the cooker stand 140 and the rise of the temperature in the control panel 150 is reduced (e.g., prevented), as compared with an implementation in which the cooker stand 140 is arranged to contact with the control panel 150 directly.

As shown in an arrow of FIG. 5, the heat of the cooker stand 140 is conducted to the projection 132 provided in the front portion of the top plate 130 and the heat of the projection 132 is conducted to the control panel 150 thereafter. Accordingly, the projection 132 provided in the top plate 130 may reduce (e.g., prevent) the heat of the cooker stand 140 from being directly conducted (or transferred) to the control panel 150.

Figure 6:
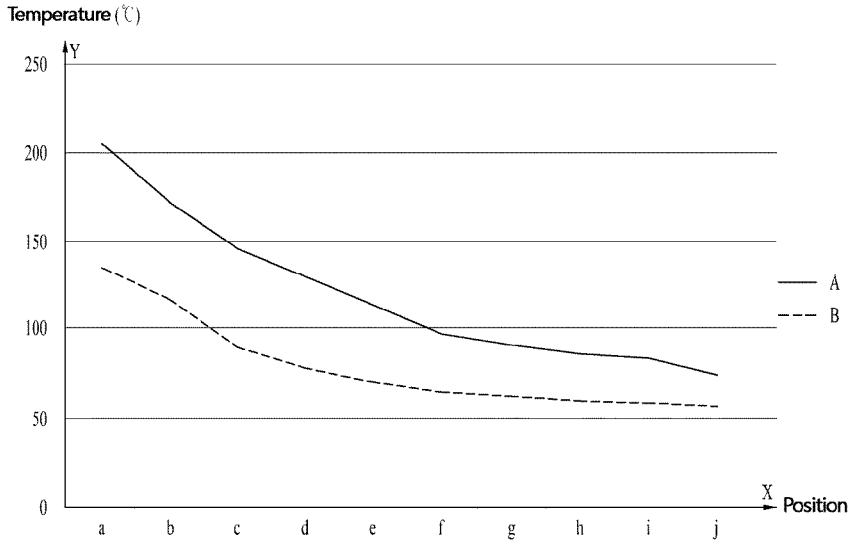
FIG. 6 is a graph showing comparison temperatures in the control panel provided in a conventional cooking appliance and the control panel provided in the cooking appliance shown in FIG. 2.

In addition, heat transfer measurements were taken in experiments for temperature variation in the control panel 150 shown in FIG. 5. Referring to FIG. 6, temperatures of the control panel provided in a conventional cooking appliance are compared with temperatures of the control panel provided in the cooking appliance in accordance with the present disclosure (e.g., the cooking appliance shown in FIGS. 2-5).

FIG. 6 includes a graph showing comparison between temperatures in the control panel provided in the conventional cooking appliance and temperatures in the control panel provided in the cooking appliance shown in FIG. 2. In FIG. 6, "A" refers to temperatures of the control panel provided in the conventional cooking appliance and "B" refers to temperatures of the control panel 150 provided in the cooking appliance in accordance with the present disclosure. In FIG. 6, X-axis refers to positions (points) where the temperatures are measured in the control panel and Y-axis refers to the temperatures measured at the points.

Referring to FIGS. 5 and 6, experiments related to the temperatures of the control panel 150 were performed for a plurality of points (a~j) from a proximal end (a) closest to the cooker stand 140 to a distal end (j) farthest from the cooker stand 140 with respect to the control panel 150. As shown in FIG. 6, the temperatures of the control panel provided in the conventional cooking appliance are generally higher than the temperatures of the control panel 150 provided in the cooking appliance in accordance with the present disclosure. For example, the temperature of the proximal end (a) closest to the cooker stand 140 is approximately 203.8° C. in the conventional cooking appliance and approximately 134.6° C. in the cooking appliance in accordance with the present disclosure.

Through such the experiments, it is shown that the projection 132 provided in the front portion of the top plate 130 reduces the heat (in other words, the capacity of the heat) conducted to the control panel 150, as compared to the conventional cooking appliance. Compared with the conventional cooking appliance, the cooking appliance in accordance with the present disclosure may reduce or prevent risk of burns which might occur to the user manipulating the control panel 150.

Figure 7:
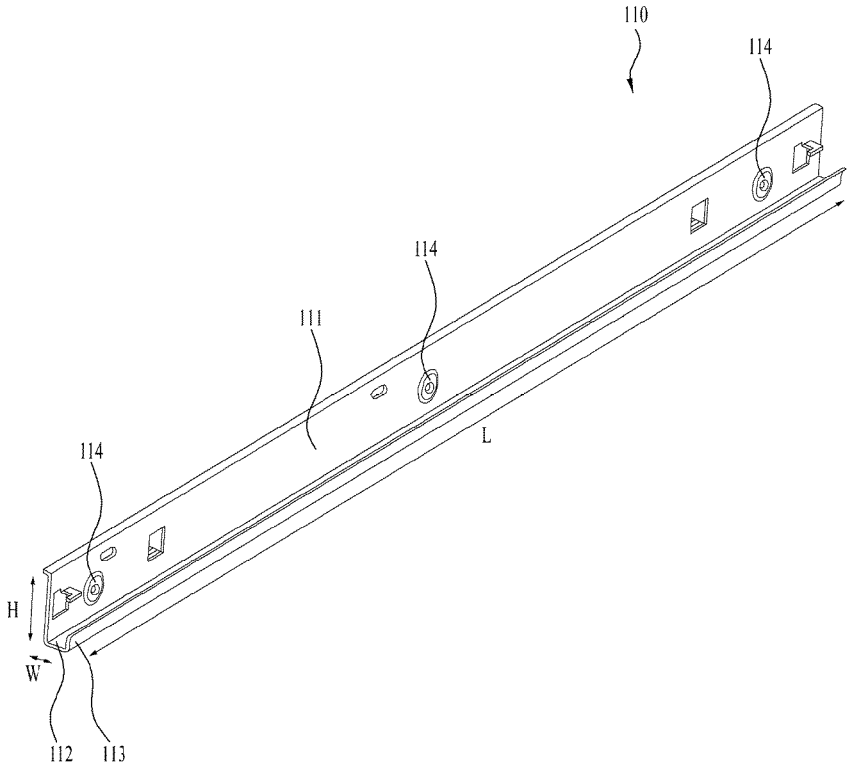
FIG. 7 is a diagram illustrating an example bracket provided in the cooking appliance shown in FIG. 2.
Figure 8:
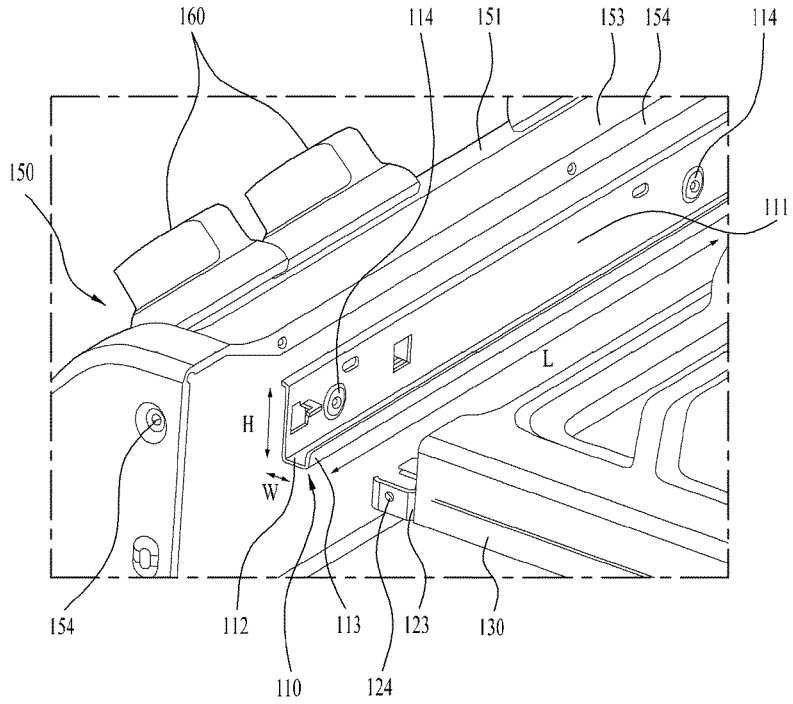
FIG. 8 is a diagram illustrating a state in which the control panel, the bracket, and the top plate are fixed to each other in the cooking appliance shown in FIG. 2.

Referring to FIGS. 7 and 8, an example bracket provided between the control panel 150 and the top plate 130 to couple the control panel 150 to the top plate 130 easily and stably will be described in more detail.

FIG. 7 illustrates an example bracket provided in the cooking appliance shown in FIG. 2 and FIG. 8 illustrates an example state in which the control panel, the bracket, and the top plate are fixed to each other in the cooking appliance shown in FIG. 2.

Referring to FIGS. 7 and 8, the bracket 110 provided in the cooking appliance 100 has a predetermined length. When describing the bracket 110, "L" direction shown in FIGS. 7 and 8 is referred to as a longitudinal direction and "W" direction is referred to as a width direction. "H" direction is referred to as a height direction (or a vertical direction).

The bracket 110 may include a vertical portion 111 vertically extended through an overall length of the bracket 110. In this regard, the bracket 110 may include the vertical portion 111 to have a predetermined height through the overall length of the bracket 110.

One or more projections 114 may be projected a preset thickness from the vertical portion 111 toward the top plate 130. For example, the projections 114 may be formed in a lateral surface of the vertical portion 111 toward the top plate and the projections 114 may be spaced apart a preset distance from each other along a longitudinal direction of the vertical portion 111.

A fastening hole is formed in each of the projections and a fastening hole corresponding to the fastening hole of the projection may be formed in a front surface of the top plate 130. Accordingly, a fastening member (e.g., a bolt) penetrates the fastening hole formed in the projection 114 and the fastening hole formed in the front surface of the top plate 130 to couple the bracket 110 to the front surface of the top plate 130.

With this arrangement, the projections 114 provided in the vertical portion 111 may be projected toward the top plate 130 so that the other portion of the vertical portion 111 except the projections 114 may be distant from the front surface of the top plate 130 as far as a projected distance of the projection 114 (e.g., a projected thickness of the projection 114). For example, the projections 114 may be formed in a height-direction central portion of the vertical portion 111. In this example, the bracket 110 (e.g., the vertical portion of the bracket) is coupled to the top plate 130 and an upper portion of the projection 114 may be spaced apart a predetermined distance from the front surface of the top plate 130. In this regard, the upper portion of the vertical portion 111 may be distant from the top plate 130 as far as the thickness of the projection 114.

Also, the control panel 150 may include a rear wall 154 extended from a rear portion to a lower portion of the control panel 150. With this configuration, the rear wall 154 of the control panel 150 may be fitted between the vertical portion 111 and the front surface of the top plate 130 so that the control panel 150 may be secured between the vertical portion 111 and the top plate 130. Specifically, the control panel 150 may include a plane surface 153 defining a virtual top thereof, an inclined surface 151 extended from one side of the plane surface 153 and the rear wall 154 extended from the other side of the plane surface 153.

The plane surface 153 may be extended, with a predetermined length and a predetermined width. The width of the plane surface 153 may be smaller than the length of the plane surface 153.

The inclined surface 151 may be extended from the front side of the plane surface 153. Specifically, the inclined surface 151 may be extended from a front end of the plane surface 153 and inclined downward toward the front portion of the cooking appliance 100.

The manipulation unit 160 may be provided in the inclined surface 151 to control the first cooking unit 135. For instance, the manipulation unit 160 may be vertically projected from the inclined surface 151.

The rear wall 154 may be extended from a rear end of the plane surface 153.

Specifically, the rear wall 154 may be extended from a rear end of the plane surface 153 and inclined downward.

As the rear wall 154 is fitted in a space (e.g., a gap or an aperture) formed between the vertical portion 111 of the bracket 110 and the front surface of the top plate 130, the control panel 150 may be fixedly coupled to the front portion of the top plate 130.

In addition, the thickness (or the width) of the rear wall 154 provided in the control panel 150 may be equal to or larger than the gap (or aperture) between the upper portion of the vertical portion 111 (e.g., the upper portion of the projection 114 provided in the vertical portion 111) and the top plate 130.

For instance, the thickness (or the width) of the rear wall 154 may be larger than the gap (or the aperture) between the upper portion of the projection 114 with respect to the vertical portion 111 and the top plate 130. Accordingly, the rear wall 154 of the control panel 150 may be forcibly fitted in the gap between the bracket 110 and the top plate 130.

After the rear wall 154 of the control panel 150 is fitted in the gap formed between the bracket 110 and the top plate 130, the fastening hole 157 formed in each of the longitudinal-direction surfaces of the control panel 150 and the fastening hole 124 formed in the side bracket 123, corresponding to the fastening hole 157, are coupled to each other by a fastening member (e.g., a bolt). The longitudinal-direction surfaces of the control panel 150 may be stably secured to the side bracket 123.

When an error occurs in the manipulation units 160 provided in the control panel 150 or the gas valve 136 or the gas line 137 connected with the manipulation unit 160, the fastening members are unfastened from the longitudinal-direction surfaces of the control panel 150 and the control panel 150 is pulled upward to be decoupled. This coupling structure facilitates the coupling and decoupling process between the top plate 130 and the control panel 150 so that the maintenance for the manipulation units 160, the gas control valve 136, and the gas line 137 provided in the cooking appliance 100 may be facilitated.

Also, the bracket 110 may further include a horizontal portion 112 extended from a lower end of the vertical portion 111 in a horizontal direction (or a width direction), to form a passage for accommodating and guiding the liquid flowing between the rear wall 154 of the control panel 150 and the front surface of the top plate 130. For example, the horizontal portion 112 may be extended from the lower end of the vertical portion 111 toward the top plate 130, with a predetermined width. Accordingly, the liquid permeating between the control panel 150 and the top plate 130 (e.g., between the rear wall 154 and the front surface of the top plate 130) may fall to the horizontal portion 112 of the bracket 110.

A width-direction end of the horizontal portion 112 may be connected to the lower end of the vertical portion 111 and a guide rib 113 may be extended upward from the other width-direction end of the horizontal portion. In this regard, the vertical portion 111 may be extended from a width-direction end of the horizontal portion 1112 in a height direction and the guide rib 113 may be extended from the other width-direction end of the horizontal portion 112 in a height direction.

When liquid permeating between the control panel 150 and the top plate 130 falls on the horizontal portion 112 of the bracket 110, the liquid may flow only along a longitudinal direction of the horizontal portion 112. The guide rib 113 may be provided in the other width-direction end of the horizontal portion 112 through the overall longitudinal direction of the horizontal portion 112. After the liquid permeating between the control panel 150 and the top plate 130 falls on the horizontal portion 112, the liquid may be guided along a longitudinal direction of the horizontal portion 112, without leaving the overall longitudinal-direction area of the horizontal portion 112 in a width direction of the horizontal portion 112.

The horizontal portion 112 may be inclined toward both longitudinal-direction ends of the horizontal portion 112 from a longitudinal-direction center of the horizontal portion 112. Specifically, both longitudinal-direction ends of the horizontal portion 112 may be inclined downward a predetermined angle with respect to the longitudinal-direction center of the horizontal portion 112. In this regard, the center of the horizontal portion 112 may be higher than the longitudinal-direction ends of the horizontal portion 112. The liquid falling on the horizontal portion 112 may be guided to the longitudinal-direction ends of the horizontal portion 112.

The vertical portion 111, the horizontal portion 112, and the guide rib 113 form a passage for guiding liquid to the longitudinal-direction ends of the bracket 110 so that the liquid may be blocked from falling on the gas control valve 136 and the gas line 137 (see FIG. 2) arranged under the bracket 110. In case the liquid, such as oil, is solidified after falling on the gas control valve 136 and the gas line 137 (see FIG. 2), an error may occur in the manipulation units 160. However, the bracket 110 may prevent the liquid from entering into the gas control valve 136 and the gas line 137, thereby preventing the liquid from causing an error.

The vertical portion 111, the horizontal portion 112, and the guide rib 113 may be integrally formed with each other or independently fabricated to be coupled to each other. In addition, the longitudinal ends of the bracket 110 may be formed open. The width-direction ends of the bracket 110 may be shut off by the vertical portion 111 and the guide rib 113. However, the longitudinal ends of the bracket 110 may be open.

The liquid falling on the horizontal portion 112 may be guided to the longitudinal ends of the bracket 110. The liquid then may flow along an inner surface of the cabinet 120 or solidify. The liquid may be prevented from flowing or falling to the gas control valve 136 and the gas line 137, which can be arranged under the bracket 110 (e.g., the horizontal portion) by the horizontal portion 112.

Further, an upper end of the vertical portion 111 provided in the bracket 110 may be bendable toward the front portion of the cooking appliance 100 (e.g., toward the control panel 150). Related with the upper end of the vertical portion 111 and the coupling process of the control panel will be described in more detail below.

Figure 9:
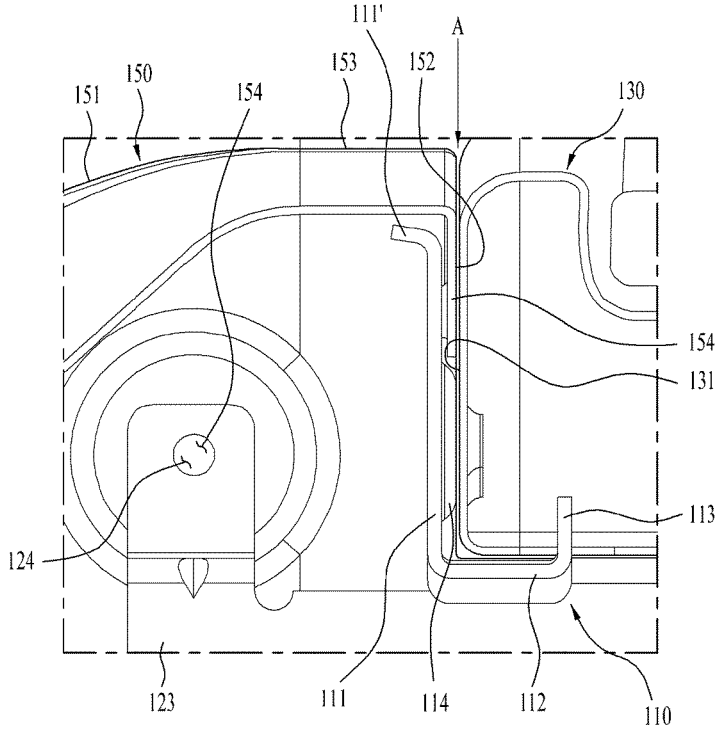
FIG. 9 is a sectional diagram illustrating a state in which the control panel, the bracket, and the top plate are fixed to each other in the cooking appliance shown in FIG. 2.

FIG. 9 illustrates an example state in which the control panel 150, the bracket 110, and the top plate 130 are fixed to each other in the cooking appliance shown in FIG. 2. Referring to FIGS. 2 and 9, the bracket 110 may be coupled to the front of the top plate 130. As mentioned above, the bracket 110 may include the vertical portion 111, the horizontal portion 112, and the rib 113.

The projection 114 provided in the vertical portion 111 is projected toward the top plate 130. When the bracket 110 is coupled to the top plate 130, the other portion of the vertical portion 111 except the projection 114 may be distant from the front surface 131 of the top plate 130 as far as the thickness (or the width) of the projection 114.

Specifically, when the projection 114 is formed in the height-direction center of the vertical portion 111, the upper portion and the lower portion of the vertical portion 111 with respect to the projection 114 may be distance from the front surface 131 of the top plate 130.

A fastening member, such as a bolt, may be inserted in the fastening hole formed in the projection 114 to stably couple the bracket 110 to the top plate 130 and arrive at the configuration shown in FIG. 9. The rear wall 154 of the control panel 150 may be fitted in the gap formed between the vertical portion 111 and the front surface 131 of the top plate 130.

The thickness or width of the rear wall 154 may be larger or smaller than the gap formed between the vertical portion 111 and the front surface 131 of the top plate 130. For example, when the thickness or width of the rear wall 154 is larger than the gap formed between the vertical portion 111 and the front surface 131 of the top plate 130, the rear wall 154 may be forcibly fitted between the vertical portion 111 and the front surface 131 of the top plate 130. Alternatively, when the thickness or width of the rear wall 154 is larger than the gap formed between the vertical portion 111 and the front surface 131 of the top plate 130, the rear wall 154 may be softly (or easily) fitted between the vertical portion 111 and the front surface 131 of the top plate 130 and then the control panel 150, the bracket 110, and the top plate 130 may be fastened to each other by auxiliary fasteners, such as a bolt.

Also, in the case in which the rear wall 154 is forcibly fitted between the vertical portion 111 and the front surface 131 of the top plate 130, the control panel 50, the bracket 110, and the top plate 130 may be coupled to each other by auxiliary fasteners.

In some examples, the auxiliary fastener may penetrate the vertical portion 111, the rear wall 154, and the front surface 131 of the top plate 130 from a top of the projection 114 mentioned above. Such an auxiliary fastener may be adopted or not adopted according to a manufacturing process or a product.

After the rear wall 154 of the control panel 150 is fitted between the vertical portion 111 and the front surface 131 of the top plate 130, the fastening member, such as a bolt, is inserted in the fastening hole 157 provided in the longitudinal surfaces of the control panel and the fastening hole 124 formed in the side bracket 123 provided in each of the width-direction surfaces, corresponding to the fastening hole 157, so that the control panel 150 can be stably secured to the cabinet 120.

Also, an upper end 111' of the vertical portion 111 provided in the bracket 110 may be bendable toward the front portion of the cooking appliance 100. As the upper end 111' of the vertical portion 111 is bendable, the rear wall 154 of the control panel 150 may be easily fitted between the vertical portion 111 and the front surface 131 of the top plate 130. Specifically, the upper end 111' of the vertical portion 111 may be bendable a predetermined angle (e.g., 30 degrees through 85 degrees) in a direction away from the top plate 130. In some examples, the bending upper end 111' of the vertical portion 111 may be formed through the overall longitudinal area of the vertical portion 111. Accordingly, the rear wall 154 may be easily fitted between the vertical portion 111 and the front surface 131 of the top plate 130.

When the rear wall 154 of the control panel 150 is fitted between the vertical portion 111 and the top plate 130 in the case in which the upper end 111' of the vertical portion 111 is not bendable, the upper end of the vertical portion 111 may damage the plane surface 153 of the control panel 150.

When the rear wall 154 of the control panel 150 is fitted between the vertical portion 111 and the top plate 130 as the rear wall 154 of the control panel 150 is pressed downward by the bending upper end 111' of the vertical portion 111, the plane surface 153 of the control panel 150 is prevented from being interfered with or damaged by the upper end 111' of the vertical portion 111.

In addition, a liquid overflowing from a cooking device on the top plate 130 or generated from condensation of vapors generated while cooking may be permeated between the control panel 150 and the top plate 130 which occurs in the "A" direction shown in FIG. 9.

The liquid permeated along the "A" direction (e.g., the liquid permeated between the rear surface 152 of the control panel 150 and the front surface 131 of the top plate 130) is flowing downward by the gravity. The liquid flowing downward may flow to the horizontal portion 112 of the bracket 110 (e.g., fall on the horizontal portion 112).

For instance, to make the downwardly flowing liquid fall on the horizontal portion 112, the horizontal portion 112 may be extended toward the top plate 130 through the front surface 131 of the top plate 130 (e.g., toward the rear portion of the cooking appliance 100), with a predetermined width.

Specifically, when the horizontal portion 112 is provided between a lower end of the vertical portion 111 and a lower end of the guide rib 113, the vertical portion 111 may be arranged in the front portion of the cooking appliance 100, rather than in front of the front surface 131 of the top plate 130. The guide rib 113 may be arranged in the rear portion of the cooking appliance 100, rather than the front surface 131.

The horizontal portion 112 gets more inclined downward toward the longitudinal ends of the horizontal portion 112 from the longitudinal center of the horizontal portion 112 so that liquid falling on the horizontal portion 112 may flow toward the longitudinal ends of the horizontal portion 112.

The liquid flowing on the horizontal portion 112 may solidify on the horizontal portion 112 or flow to the longitudinal ends of the horizontal portion 112 to be solidified on the width-direction surfaces of the cabinet 120. In some examples, most of the liquid flowing on the horizontal portion 112 may be solidified on the horizontal portion 112.

The liquid permeated along the "A" direction by the bracket 110 (e.g., the horizontal portion 112) is prevented from falling on the gas control valve 136 or the gas line 137 arranged under the bracket 110 so that an error of the manipulation units 160 can be prevented.

As mentioned above, the control panel 150 is decoupled and the bracket 110 is decoupled from the top plate 130. After that, foreign substances solidified on the horizontal portion 112 of the bracket 110 can be cleaned easily.

Although implementations have been described with reference to a number of illustrative examples thereof, it should be understood that numerous other modifications and implementations can be devised by those skilled in the art that will fall within the spirit and scope of the principles of this disclosure. More particularly, variations and modifications are possible in the component parts and/or arrangements of the subject arrangement within the scope of the disclosure, the drawings, and the appended claims. In addition to variations and modifications in the component parts and/or arrangements, alternative uses will also be apparent to those skilled in the art.

What is claimed is:

1. A cooking appliance comprising:

a cabinet defining an exterior appearance of the cooking appliance;

a top plate disposed on the cabinet, the top plate comprising a first cooking unit configured to perform cooking using a heat source;

a cooker stand disposed on the top plate;

a control panel coupled to a front portion of the top plate, the control panel comprising one or more manipulation units; and a bracket coupled to the top plate and configured to detachably couple the control panel to the front portion of the top plate, wherein the top plate includes a projection that is projected upward at a front portion of the top plate, and wherein a rear surface of the control panel contacts a front surface of the projection, and a predetermined area of the cooker stand contacts a rear surface of the projection.

2. The cooking appliance of claim 1, wherein a gap exists between a front surface of the top plate and the bracket, and a predetermined area of the control panel is inserted into the gap such that a rear surface of the control panel contacts the front surface of the top plate.

3. The cooking appliance of claim 1:

wherein the bracket comprises a vertical portion that vertically extends throughout an overall length of the bracket and one or more projections that are projected from the vertical portion toward the top plate, and wherein an upper end of the vertical portion and the top plate are spaced apart a predetermined distance from each other with respect to the one or more projections.

4. The cooking appliance of claim 3, wherein the one or more projections comprise a plurality of projections that are provided in the vertical portion, and the plurality of the projections are spaced apart a predetermined distance from each other along a longitudinal direction of the bracket.

5. The cooking appliance of claim 3, wherein the control panel comprises a rear wall that extends downward at a rear portion of the control panel, and the rear wall is fitted between the vertical portion of the bracket and a front surface of the top plate to fixedly couple the control panel between the vertical portion of the bracket and the top plate.

6. The cooking appliance of claim 5, wherein a thickness of the rear wall is equal to or larger than a gap between an upper end of the vertical portion and the top plate.

7. The cooking appliance of claim 5, wherein the bracket further comprises, a horizontal portion that horizontally extends from a lower end of the vertical portion to define a passage configured to accommodate or guide a liquid permeated between the rear wall of the control panel and the front surface of the top plate.

8. The cooking appliance of claim 7, wherein a first width-direction end of the horizontal portion is connected to a lower end of the vertical portion and the bracket includes a guide rib that extends upward at a second width-direction end of the horizontal portion.

9. The cooking appliance of claim 7, wherein the horizontal portion is inclined toward longitudinal ends of the horizontal portion from a longitudinal center of the horizontal portion.

10. The cooking appliance of claim 3, wherein an upper end of the vertical portion is bent at a predetermined angle toward a front portion of the cooking appliance.

11. The cooking appliance of claim 1, wherein both longitudinal ends of the bracket are open.

12. The cooking appliance of claim 1, further comprising side brackets that are provided at width-direction surfaces of the cabinet, wherein longitudinal surfaces of the control panel and the side brackets are fastened to each other by one or more fastening members.

13. The cooking appliance of claim 1, wherein the control panel includes an inclined surface that is inclined downward a predetermined angle toward a front portion of the cooking appliance, and the one or more manipulation units are provided at the inclined surface.

14. The cooking appliance of claim 1, further comprising a cooker stand disposed on the top plate, wherein the cooker stand and the control panel are spaced apart a predetermined distance from each other.

15. A cooking appliance comprising:

a cabinet defining an exterior appearance of the cooking appliance;

a top plate disposed on the cabinet, the top plate comprising a first cooking unit configured to perform cooking using a heat source;

a cooker stand disposed on the top plate;

a second cooking unit provided in the cabinet, the second cooking unit being configured to perform cooking using a heat source;

a control panel coupled to a front portion of the top plate, the control panel comprising one or more manipulation units; and a bracket coupled to the top plate and configured to detachably couple the control panel to the top plate with a gap defined between an upper end of the bracket and an upper end of the top plate, wherein a part of the control panel is configured to insert into the gap defined between the bracket and the top plate to couple the control panel to the top plate, wherein the top plate includes a projection that is projected upward at a front portion of the top plate, and wherein a rear surface of the control panel contacts a front surface of the projection, and a predetermined area of the cooker stand contacts a rear surface of the projection.

16. The cooking appliance of claim 15, wherein the bracket comprises:

a vertical portion that vertically extends throughout an overall length of the bracket; and a horizontal portion that horizontally extends from a lower end of the vertical portion.

17. The cooking appliance of claim 16, wherein the horizontal portion defines a passage configured to accommodate and guide a liquid permeated between a rear wall of the control panel and a front surface of the top plate.

18. The cooking appliance of claim 16, wherein a first width-direction end of the horizontal portion is connected to a lower end of the vertical portion, and wherein the bracket comprises a guide rib that extends upward at a second width-direction end of the horizontal portion.

19. The cooking appliance of claim 16, wherein the horizontal portion is inclined toward both longitudinal ends of the horizontal portion from a longitudinal center of the bracket.

* * * * *